United States Patent [19]

Westendorf

[11] 4,085,856

[45] Apr. 25, 1978

[54] QUICK ATTACH MEANS FOR END LOADERS OR THE LIKE

[76] Inventor: Neal W. Westendorf, Smithland, Iowa 51056

[21] Appl. No.: 761,323

[22] Filed: Jan. 21, 1977

[51] Int. Cl.[2] ..... E02F 3/81

[52] U.S. Cl. ..... 214/145 A; 172/273; 403/328

[58] Field of Search ..... 214/145 A, 131 A; 172/272, 273, 274; 403/328, 324, 325

[56] References Cited

U.S. PATENT DOCUMENTS

| | | | |
|---|---|---|---|
| 3,512,665 | 5/1970 | Westendorf | 214/145 A |
| 3,964,622 | 6/1976 | Blair et al. | 172/272 |
| 3,985,249 | 10/1976 | Aker et al. | 214/145 A |

*Primary Examiner*—Drayton E. Hoffman
*Assistant Examiner*—Ross Weaver
*Attorney, Agent, or Firm*—Zarley, McKee, Thomte, Voorhees & Sease

[57] ABSTRACT

A quick attach apparatus for end loaders or the like such as tractor loaders or the like. The tractor loader includes a pair of booms operatively pivotally secured at one end thereof to the tractor. A hydraulic cylinder is operatively pivotally secured to each of the booms and is positioned over the other end thereof. A hook-up bracket is pivotally secured to the said other end of each boom and the hydraulic cylinder and includes a channel-shaped portion extending forwardly therefrom. Each of the various attachments for the loader such as buckets, forks, blades, etc. have a pair of channel-shaped pockets secured to the rearward end thereof which are adapted to receive a hook-up bracket therein. A locking apparatus is provided on each of the brackets to detachably maintain the hook-up brackets in their respective pockets. The locking apparatus includes means for yieldably maintaining the locking apparatus in an unlocked condition and means for automatically locking the locking apparatus after the hook-up bracket has been properly received within its respective pockets.

4 Claims, 12 Drawing Figures

QUICK ATTACH MEANS FOR END LOADERS OR THE LIKE

BACKGROUND OF THE INVENTION

This invention relates to a quick attach apparatus for end loaders or the like and more particularly to an improved quick attach apparatus for end loaders or the like.

Conventional end loaders such as tractor loaders or the like usually have a pair of booms pivotally secured at their rearward ends to the tractor and pivotally secured at their forward ends to the attachment by means of a pin extending through spaced apart ears on the attachment and through the boom. The hydraulic cylinders are also usually pivotally connected to the rearward end of the attachment by means of pins substantially similar to the manner in which the booms are pivotally secured to the attachment. Thus, when it is desired to remove a particular attachment from the loader, it is necessary to remove four pins and to subsequently replace the pins in another attachment. It is difficult and time consuming in attempting to position the four pins for insertion in their respective openings and the hook-up difficulty is further increased due to the fact that the piston rods of the hydraulic cylinders are sometimes difficult to align since one rod may tend to extend farther than the rod on the other hydraulic cylinder. The connection and the disconnection of the various attachments is also difficult when the attachment is not on exactly level ground.

A quick attach apparatus was previously disclosed in U.S. Pat. No. 3,512,665. The instant invention represents a significant improvement over the prior art device in that means is provided herein for maintaining the locking apparatus in an unlocked condition. Additionally, the instant invention represents an improvement over the prior device in that means is provided for automatically moving the locking apparatus from the unlocked condition to the locked condition as the hook-up brackets are received within their respective pockets.

Therefore, it is a principal object of this invention to provide a quick attach means for end loaders such as tractor loaders or the like.

A further object of the invention is to provide a quick attach means for tractor loaders or the like which permits the connection of various attachments to the loader without the tractor loader leaving the tractor.

A further object of the invention is to provide a quick attach means for tractor loaders or the like including a spring-loaded pin having a lower end configuration which facilitates connection of the hook-up brackets into their respective pockets.

A still further object of the invention is to provide a quick attach means for tractor loaders or the like including means thereon which aid in aligning the hook-up brackets in their respective pockets.

A still further object of the invention is to provide a quick attach means for end loaders or the like which is economical to manufacture, durable in use and refined in appearance.

DESCRIPTION OF THE PREFERRED EMBODIMENT

Figure 1:
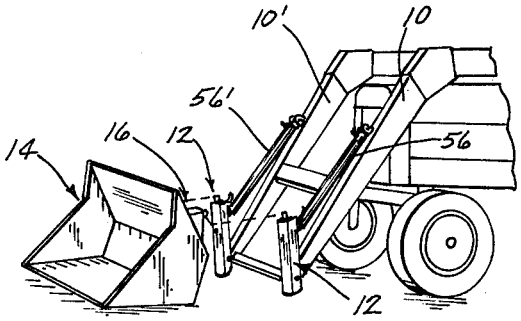
FIG. 1 is a front perspective view illustrating the quick attach means of this invention.

The numerals 10 and 10′ generally designate conventional loader booms which are pivotally connected at their rearward ends to the tractor or the like and which are raised or lowered with respect thereto by a hydraulic cylinder means which is not shown. The numerals 12 and 12′ generally designate hook-up brackets which are pivotally connected to the booms 10 and 10′ respectively. Inasmuch as hook-up brackets 12 and 12′ are identical, only hook-up bracket 12 will be described in detail with identical structure on hook-up bracket 12′ designated by "′". The numeral 14 designates a bucket attachment for the loader and it should be understood that the attachment 14 could be replaced by any of several attachments such as blades, forks, etc. A pair of pockets 16 and 16′ (not shown) are secured to the rearward end of attachment 14 in a spaced-apart relationship. Inasmuch as pockets 16 and 16′ are identical, only pocket 16 will be described in detail.

Figure 6:
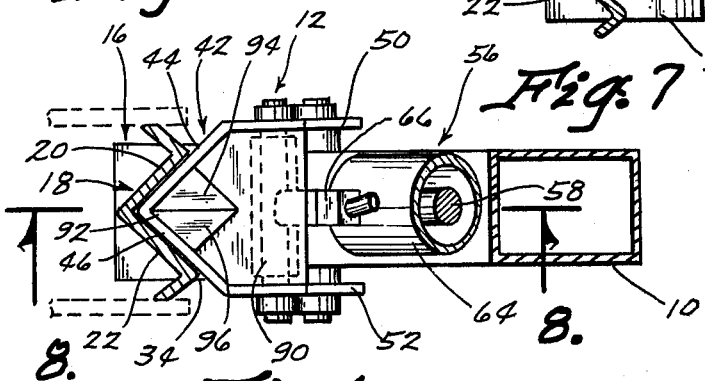
FIG. 6 is an enlarged sectional view seen on lines 6—6 of FIG. 5.
Figure 8:
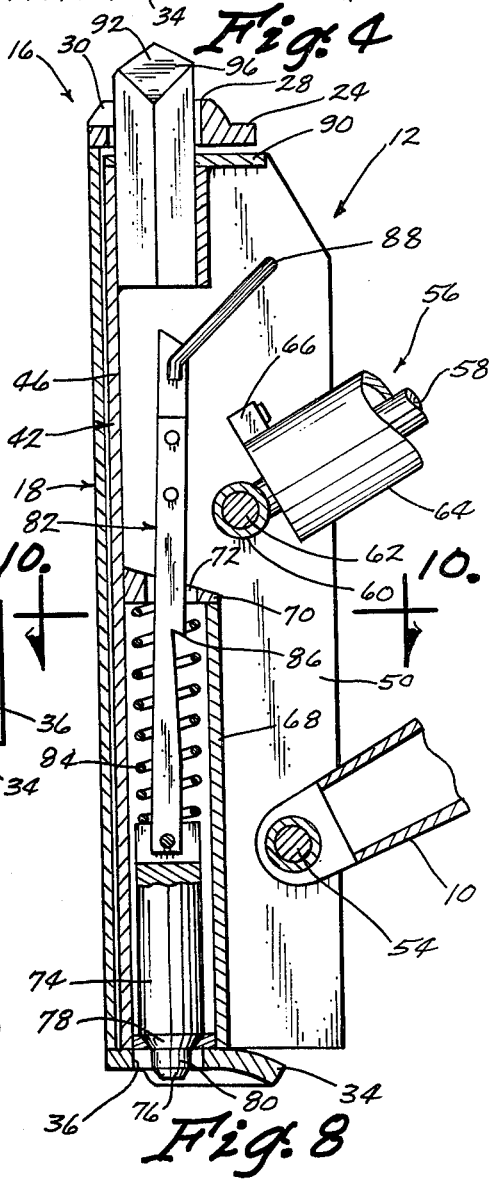
FIG. 8 is a sectional view seen on lines 8—8 of FIG. 6.
Figure 9:
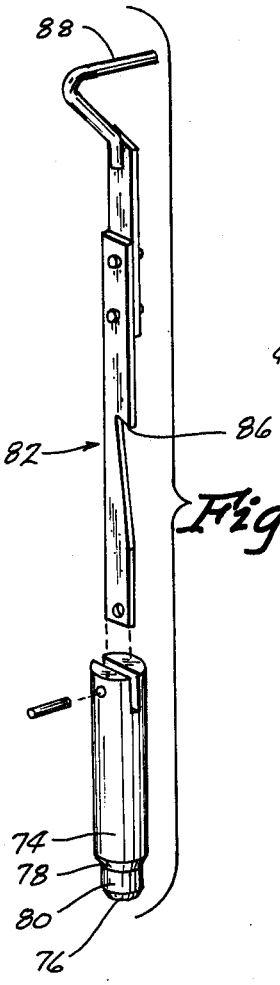
FIG. 9 is a perspective view of the locking lever portion of the device.
Figure 11:
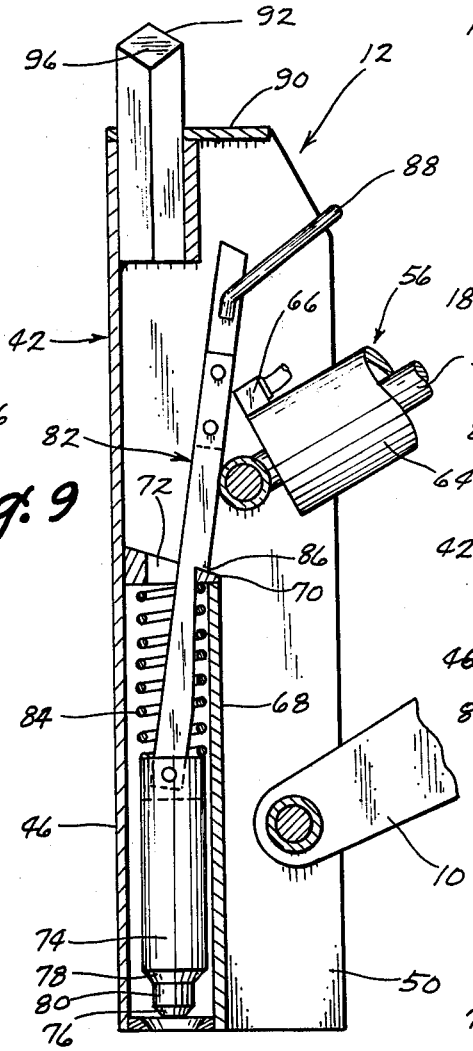
FIG. 11 is a sectional view similar to FIG. 8 except that the locking lever is shown in an unlocked condition.

Pocket 16 includes a vertically disposed channel 18 which is comprised of forward wall portions 20 and 22 generally forming the channel-shape as best illustrated in FIG. 6. A plate 24 is secured to the upper end of channel 18 and is provided with an opening 26 extending therethrough. Opening 26 is oriented so that the rearward end of the opening comes to a point at 28 while the forward end thereof comes to a point 30.

A plate 34 is secured to the lower end of channel 18 and is provided with an opening 36 formed therein. Opening 36 is oriented in the same manner as opening 26. Channel 18 is secured to the rearward end of attachment 14 by any convenient means.

Hook-up bracket 12 includes a channel 42 defined by wall portions 44 and 46 which are adapted to be received by channel 18 as illustrated in FIG. 6. As seen in FIG. 6, plate portions 50 and 52 extend rearwardly from the rearward ends of wall portions 44 and 46 respectively. Boom 10 is pivotally connected to hook-up bracket by means of a pin 54 extending through plate portion 50, boom 10 and plate portion 52 adjacent the lower ends of plate portions 50 and 52. Conventional cotter keys or the like extend through opposite ends of pin 54 to prevent inadvertent removal thereof. The numeral 56 generally designates a conventional hydraulic cylinder including a rod 58 slidably extending from the forward end thereof. A sleeve 60 is welded to the forward end of rod 58 and is adapted to receive a pin 62 extending therethrough and through the plate portions 50 and 52 adjacent the upper end thereof as illustrated in the drawings. The rearward end of hydraulic cylinder 56 is pivotally connected to boom 10 rearwardly of the forward end thereof and would be operatively connected to the tractor hydraulic system. The extension of rod 58 causes the hook-up bracket 12 to be pivoted from the position of FIG. 1 to the position of FIG. 2. Tubular member 64 is welded to the forward end of rod 58 and has a lug 66 welded thereto which extends upwardly therefrom.

A vertically disposed angle member 68 is secured to the rearward surfaces of plate portions 50 and 52 by welding or the like. Plate 70 is welded to the upper end of angle member 68 and has a rectangular opening 72 formed therein. The lower end of angle member 68 is open and movably receives a pin 74 which is positioned between angle member 68 and plate portions 50 and 52. As seen in the drawings, the lower end of pin 74 is provided with a pair of annular beveled surfaces 76 and 78 connected by cylindrical portion 80 which cooperate to assist the lower end of the pin 74 being received by the opening 36. Actuating lever 82 extends downwardly through opening 72 in plate 70 and has its lower end pivotally connected to the upper end of pin 74. Coil spring 84 embraces actuating lever 82 between the underside of plate 70 and the upper end of pin 74 to yieldably resist the upper movement of pin 74 relative to angle member 68. Actuating lever 82 is provided with a slot 86 formed in its rearward end thereof which extends upwardly and forwardly thereinto. Actuating lever 82 is provided with a handle portion 88 at its upper end. As seen in the drawings, plate 90 extends across the top of channel 18 and has an upwardly extending hook 92 provided thereon. As illustrated in the drawings, the upper end of hook 92 is beveled to provide inclined surfaces 94, 96, 98 and 100 which assist the hook 92 in being received in the opening 26 in plate 24.

The normal method of operation is as follows. Assuming that the attachment 14 is disconnected from the loader as illustrated in FIG. 1, the first step would be to position the actuating levers 82 and 82' in their unlocked position. Actuating lever 82 is pulled upwardly with respect to the angle member 68 until the slot 86 registers with the rearward end of the opening 72. The actuating lever 82 is then moved rearwardly with respect to the angle member 68 so that slot 86 will receive plate 70 which yieldably locks the actuating lever 82 in a locked position so that the lower end of pin 74 is positioned approximately level with the lower end of channel 18. Acuating lever 82' would be similarly positioned in the unlocked condition.

Figure 2:
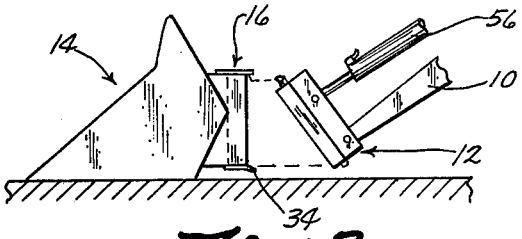
FIGS. 2, 3 and 4 are side views illustrating the connecting sequence.
Figure 3:
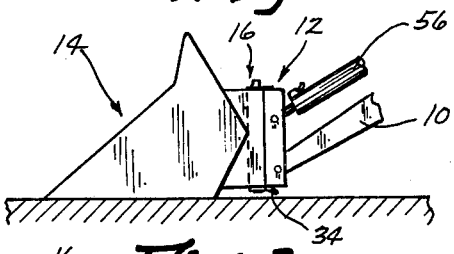
Figure 4:
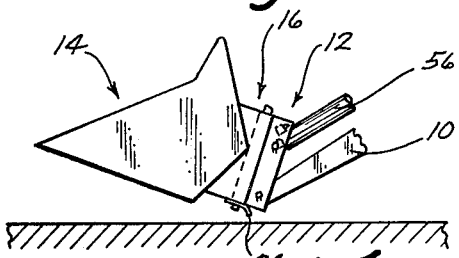
Figure 5:
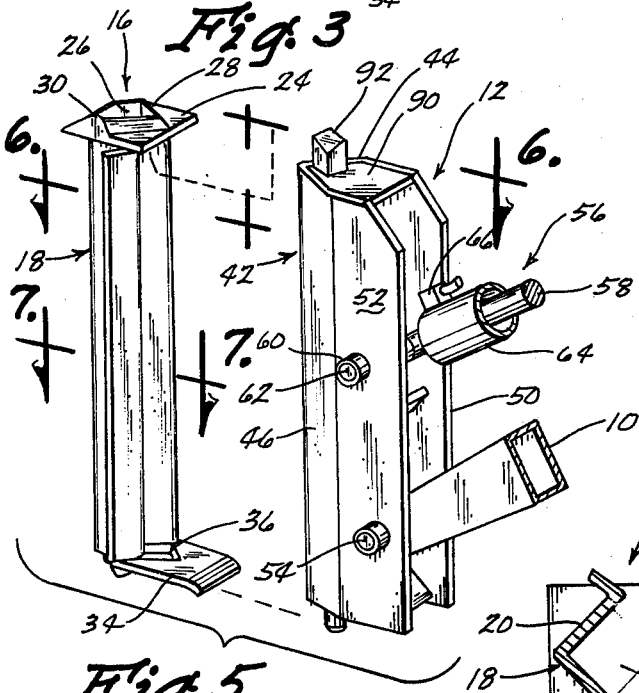
FIG. 5 is an exploded rear perspective view of the device of this invention.
Figure 7:
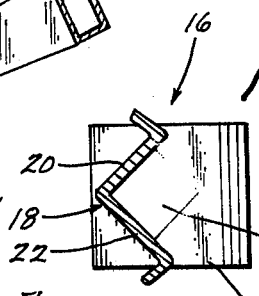
FIG. 7 is an enlarged sectional view seen on lines 7—7 of FIG. 5.

The hydraulic cylinders 56 and 56' would then be operated so that the rods 58 and 58' would slidably extend therefrom causing the upper forward ends of the hook-up brackets 12 and 12' to be tipped forwardly to the position illustrated in FIG. 2. The tractor would then be moved forwardly so that the hooks 92 and 92' would be received within channels 18 and 18'. Hydraulic cylinders 56 and 56' would then be operated so that the hooks 92 and 92' would move upwardly through the openings 26 and 26'. The configuration of the upper end of the hooks 92 and 92' assist in the hooks being received in the openings due to the inclined surfaces provided thereon. The continued rearward pivotal movement of the hook-up brackets 12 and 12' together with the raising of the boom 10 will cause the forward ends of channels 42 and 42' to be received by the pocket members 16 and 16' respectively. Continued retraction of the rods 58 and 58' causes the lugs 66 and 66' to engage the rearward ends of actuating levers 82 and 82' respectively and to move the same forwardly (FIG. 12) which causes the slots 86 and 86' to move out of engagement with the plates 70 and 70' which permits the springs 84 and 84' to force the pins 74 and 74' to be moved downwardly into the openings 36 and 36' respectively so as to lock the hook-up brackets 12 and 12' in the pocket members 16 and 16' respectively.

As soon as the pins 74 and 74' are received by the openings 36 and 36', hook-up brackets 12 and 12' have been locked into place in the pocket members 16 and 16'. The pocket members 16 and 16' will receive the brackets 12 and 12' respectively even if the attachment 14 is not on level ground since the raising of the booms 10 will tend to align the respective structural components and the mating engagement of the channels 18 and 42 and 18' and 42' wil also tend to align the structure. As illustrated in the drawings, the forward sides of wall portions 44 and 46 engage the rearward portions of wall portions 18 and 20 thereby insuring that there will be absolutely no "play" in the connection of the attachment. In effect, a "wedge inside of a wedge" mating engagement has been provided. Channel 42 is rounded at its forward end so that any wear on the mating surfaces of the channels 18 and 42 will permit the channel 42 to be further received by the channel 18 which would be otherwise prohibited by a pointed forward end of the channel 42.

The attachment 14 is disconnected from the tractor loader by simply vertically moving the actuating lever 82 and 82' until the slots 86 and 86' may receive the plates 70 and 70' respectively. The tractor can then be backed rearwardly from the attachment 14 while causing the hydraulic cylinder to tip the hook-up brackets 12 and 12' forwardly to that the hooks 92 and 92' can move out of the openings 26 and 26' respectively.

In can be seen that a quick attach apparatus has been provided for connecting various attachments to a tractor loader or the like which does not require that the operator of the tractor leave the operator's platform during the connection of the attachment to the loader. Various attachments may be quickly and easily connected to the loader without the necessity of attempting to align various pins, openings, etc.

Figure 12:
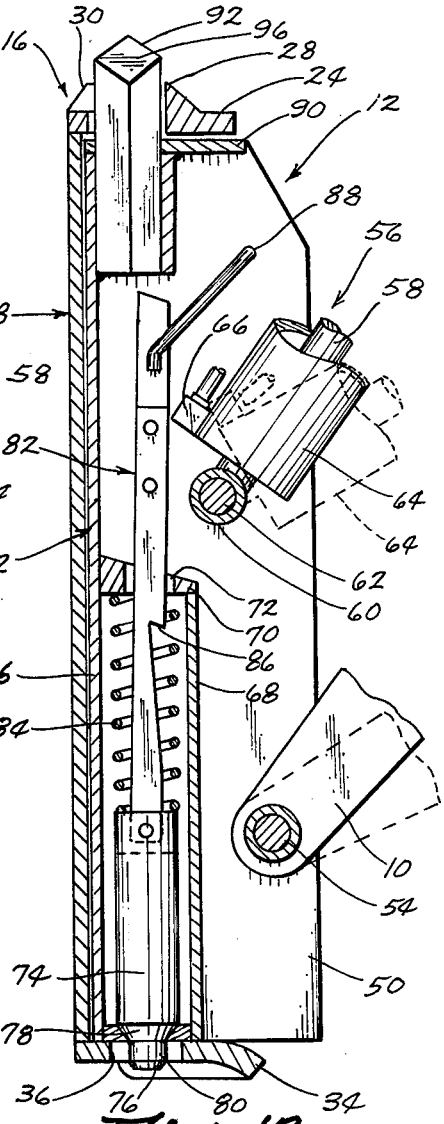
FIG. 12 is a view similar to FIG. 11 except that the locking lever has moved to the locking position.
Figure 10:
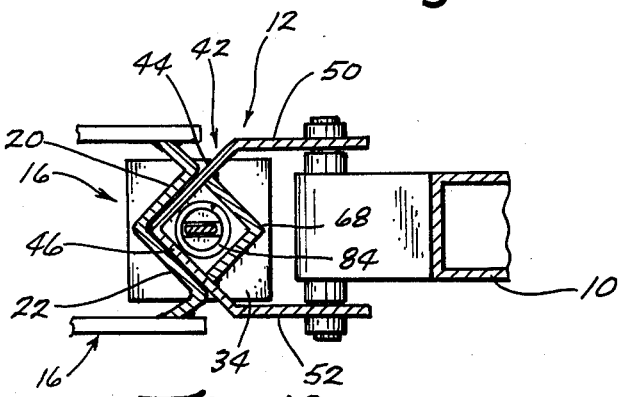
FIG. 10 is a sectional view seen on lines 10—10 of FIG. 8.

The relationship of the upper end of lever 82 and the lower end of hook 92 is also very important. As seen in FIG. 12, the upper end of lever 82 is positioned below hook 92 so that external upward pressure on pin 74 will cause lever 82 to engage the lower end of hook 92 to prevent pin 74 from disengaging from plate 34.

Thus it can be seen that the quick attach means of this invention accomplishes at least all of its stated objectives.

I claim:

1. In combination, an end loader adapted to be mounted on a powered vehicle and including a pair of pivotal booms, said end loader including a pair of hydraulic cylinders which are each pivotally connected at one end to one of said booms, a first hook-up bracket means pivotally secured to one of said booms and one of said hydraulic cylinders, a second hook-up bracket means pivotally secured to the other of said booms and the other of said hydraulic cylinders, an attachment having a pair of spaced-apart pocket means secured to its rearward end which are adapted to detachably receive said hook-up bracket means therein, each of said pocket means including a channel having upper and lower ends, a top plate secured to the upper end of said channel, a bottom plate secured to the lower end of said channel, each of said hook-up bracket means including a channel having upper and lower ends, said bracket means channel being received by said pocket means channel between said top and bottom plates, and a locking means secured to each of said hook-up bracket means, each of said locking means including a spring-loaded plunger means which is generally vertically movable within the lateral confines of said hook-up bracket means from an unlocked position to a locked position, each of said plunger means being received by one of said bottom plates when in said locked position when said bracket means channel is received by said pocket means channel, said locking means including coacting means on said plunger and on said hook-up bracket means rearwardly of said plunger for maintaining said spring-loaded plunger means in its unlocked condition, said coacting means movable fore and aft into and out of engagement, and means for automatically disengaging said coacting means for movement of said plunger means to their locked position upon a predetermined amount of pivotal movement of said bracket means relative to said pivotal booms.

2. The combination of claim 1 wherein each of said locking means comprises a locking lever secured to one of said plunger means for pivotal movement about a transverse axis through said plunger means, said lever extending upwardly from said plunger means and having a locking surface provided on its rearward end, said coacting means including said locking surface and a support positioned rearwardly of said lever whereby said locking surface engages said support when the plunger means is in its said unlocked position.

3. The combination of claim 2 wherein a lug means is operatively secured to each of said hydraulic cylinders, said lug means engaging said locking lever to move said locking surface out of engagement with said support upon said predetermined amount of pivotal movement.

4. The combination of claim 2 wherein each of said bracket means channels have a hook means extending upwardly therefrom, each of said top plates of said pocket means channels having an opening formed therein which receive one of said hook means when said bracket means channels are received by said pocket means channels, the upper ends of said locking levers being positioned closely adjacent and below said hook means when said locking levers are in their locked positions to prevent inadvertent upward movement of said plunger means caused by external forces.

* * * * *